United States Patent [19]

Yamada et al.

[11] Patent Number: 5,000,417

[45] Date of Patent: Mar. 19, 1991

[54] MAGNETIC FIXING MEMBER FOR A PAPER BOX

[75] Inventors: Meiko Yamada, Yokohama; Hajime Uda, Matsudo, both of Japan

[73] Assignee: Lec Kabushiki Kaisha, Tokyo, Japan

[21] Appl. No.: 375,185

[22] Filed: Jul. 3, 1989

[30] Foreign Application Priority Data

Apr. 7, 1989 [JP] Japan ..... 1-41219[U]

[51] Int. Cl.[5] ..... A47F 5/08

[52] U.S. Cl. ..... 248/683; 248/206.5; 248/309.4; 335/303

[58] Field of Search ..... 248/544, 467, 206.5, 248/309.4, 500, 683; 335/303; 206/350, 818; 40/600; 403/DIG. 1; 24/303, 49 M; 211/DIG. 1, 88

[56] References Cited

U.S. PATENT DOCUMENTS

| | | | |
|---|---|---|---|
| 2,297,806 | 10/1942 | Smith | 248/309.4 |
| 2,959,832 | 11/1960 | Baermann | 211/DIG. 1 |
| 3,727,658 | 4/1973 | Eldridge, Jr. | 335/303 |
| 3,842,980 | 10/1974 | Kushner | 211/DIG. 1 |
| 3,868,016 | 2/1975 | Szpur | 211/DIG. 1 |
| 4,544,067 | 10/1985 | Miller | 248/309.4 |
| 4,736,853 | 4/1988 | O'Mara | 248/206.5 |

FOREIGN PATENT DOCUMENTS

| | | | |
|---|---|---|---|
| 950273 | 2/1964 | United Kingdom | 335/303 |
| 1025616 | 4/1966 | United Kingdom | 335/303 |

OTHER PUBLICATIONS

Gardner, Annesta R., "Flexible Magnets", Jan. 9, 1961, Product Engineering, pp. 65–68.

*Primary Examiner*—Ramon O. Ramirez
*Assistant Examiner*—Robert A. Olson
*Attorney, Agent, or Firm*—Fleit, Jacobson, Cohn, Price, Holman & Stern

[57] ABSTRACT

A magnetic fixing member is produced by fitting a metal plate having suitable magnetism to one of the surfaces of a thin sheet-like ferrite type anisotropic rubber manget. The size of the fixing member is determined so as to be fitted into a gap defined between a paper package box to be held by the force of magnetic attraction of the rubber magnet and the contents of the paper package box. The rubber magnet sheet has at least two poles magnetized on one of its planes.

7 Claims, 2 Drawing Sheets

MAGNETIC FIXING MEMBER FOR A PAPER BOX

BACKGROUND OF THE INVENTION

The present invention relates to a magnetic fixing member capable of being removably fitted in a package box made of paper, which accommodates therein a wrapping film for wrapping foodstuffs, an aluminum foil, tissue paper or the like (hereinafter referred to as the "wrapper"), and attaching the package to a vertical surface of, e.g., a household refrigerator.

The wrapper described above is usually stored in a paper package box and, when not used, the paper box is put onto a shelf or into a drawer, and is taken out whenever the wrapper is to be used. Though it is desirable to eliminate the trouble of taking out and returning the package box from and onto or into the shelf or drawer whenever the wrapper is to be used, no conventional paper package box can satisfy such a need.

The vertical side or front surface of a household refrigerator, for example, is a convenient fitting place for the package at which acess to the box is not hampered. When the paper box is fitted to such an iron surface, a magnet has been used conventionally. Therefore, it is possible, in principle, to removably and magnetically hold the paper package box itself on the vertical side surface by the force of magnetic attraction by bonding onto the surface of the paper box directly a ferrite type rubber magnet obtained by mixing and kneading a synthetic rubber or a polymer resin and ferrite magnet powder, rolling or extruding and the molding the mixture. However, if the rubber magnet is attracted onto and below the side panel of the refrigerator for a long period, the mating attraction surface of the refrigerator may get darkish, and such darkish areas cannot be removed easily by cleaning. The dirt becomes particularly remarkable on a white surface.

If a replaceable fitting member is desired, it is possible to employ an arrangement wherein a screw shaft implanted in a fixing member is pierced from inside through the paper box to project outward therefrom and to fit a pin magnet or the like to the screw shaft. However, the trouble of piercing or screwing has not at all been accepted by customers.

SUMMARY OF THE INVENTION

With the background described above, an object of the present invention is to provide a fixing member which can be removed and fitted and be used repeatedly without troubling a user and does which not make the attraction surface to which the magnet is applied darkish.

Another object of the present invention is to provide a fixing member which can indicate an show, without fail, a correct side of the paper box exhibiting the force of magnetic attraction to present the mistake of selecting an incorrect side of magnetic attraction.

Generally, the inner dimension of the paper box is somewhat greater, by about 2 mm, for example, than the diameter of the wrapper stored therein. The present invention contemplates accomplishing the object described above by utilizing this limited gap so that the magnetic fixing member can be fitted into and taken out of this gap. In other words, the magnetic fixing member in accordance with the present invention is produced by fitting a metal plate having suitable magnetism to one of the surfaces of a thin sheet-like ferrite type anisotropic rubber magnet. The size of the fixing member is determined such that the fixing member can be fitted into the gap defined between a package box made of paper to be held by the force of magnetic attraction of the rubber magnet and the contents of the paper package box. The fixing can be accommodated in a rectangular shape of the side surface of the paper package box. At least two poles are magnetized on one plane of the rubber magnet.

In connection with the size of the gap described above, the magnetic fixing member of the invention includes a portion which can be fitted into the gap defined between the paper package box to be held by the force of magnetic attraction of the rubber magnet and the contents of the box. Preferably, the fixing member is formed in substantially the same rectangular shape as the side surface of the paper package box, and includes marking portions formed at the upper edge of the magnetic metal plate to project upward therefrom and outward of the paper package box.

Since the ferrite type anisotropic rubber magnet has a large flux density and a large coercive force, it can be made thin and the force of magnetic attraction can be increased by combining it with the magnetic metal plate. Therefore, even if its size is such that it can be fitted into the gap between the paper package box and wrapper or other contents inside the paper box, it can securely hold the paper box. Since at least two poles are magnetized on one plane of the rubber magnet, the paper box is strongly prevented from sliding and falling under its own weight when it is attracted magnetically onto the vertical surface of the refrigerator or the like.

If the mark portions are formed at the upper edge of the portion stored in the rectangular shape of the side surface of the paper box in such a manner as to project upward therefrom and outward from the paper box, they indicate the side of the magnetic attraction so that the paper box can be fitted correctly to the surface of a refrigerator or the like.

DESCRIPTION OF THE PREFERRED EMBODIMENTS

Hereinafter, several preferred embodiments of the present invention will be described with reference to the accompanying drawings.

Figure 1:
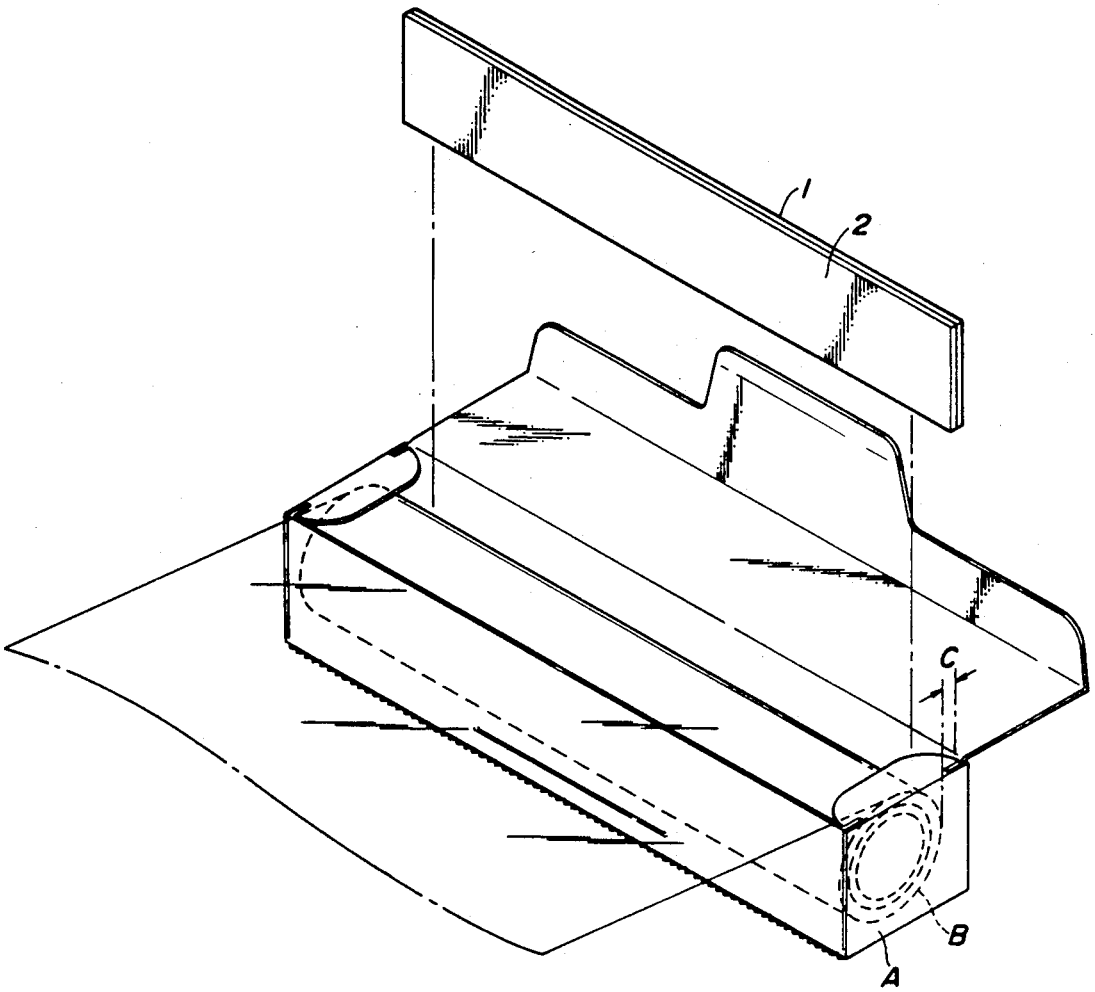
FIG. 1 is a perspective view of a magnetic fixing member in accordance with the present invention and a paper package box supported by the magnetic fixing member.

In FIG. 1, a package box generally shown by reference symbol A is made of paper for storing therein a wrapper B. As described already, the inner dimension of the paper box A is somewhat greater than the diameter or the roll at wrapper B its contains, with a gap C formed between the paper box and the wrapper.

The magnetic fixing member in accordance with the present invention is produced by fitting a suitable magnetic metal plate 2 to one of the surfaces of a ferrite type anisotropic rubber magnet 1, and the size of the fixing member is such that it can be fitted into the gap C defined between the paper box A to be held by the force of magnetic attraction of the rubber magnet 1 and the content B of the paper box A. The magnetic fixing member and can be stored in a rectangular portion or even defined by the side surface of the paper box A.

If the gap is about 2 mm, for example, the thickness of the anisotropic rubber magnet 1 is from about 0.8 to 1 mm and the thickness of the magnetic metal plate 2 is from about 0.5 to 0.6 mm. Generally, paper boxes A of this kind are available in the market and have a substantially square sectional shape. There is no reason at all why this magnetic fixing member must be fitted to the bottom or side. Therefore, the term "side surface" of the paper box A does not exclude the bottom surface.

Magnetization of the rubber magnet 1 may be single-face magnetization or double-face magnetization and the direction of magnetization may be parallel or perpendicular to the longitudinal direction of the rubber magnet 1, but at least two poles are magnetized on one plane surface. The rubber magnet 1 may be magnetized while the magnetic metal plate 2 is put thereon or the magnetic metal plate 2 may be bonded to a rubber magnet 1 which has been magnetized. Bonding may be achieved by magnetic force of attraction or through the use of an adhesive.

To use the magnetic fixing member of the present invention, it is inserted from above the gap C and fitted in such a manner that the surface of the rubber magnet 1 faces the inner side surface of the paper box A and the surface of the magnetic metal plate 2 faces the wrapper B as the contents of box A.

Figure 2:
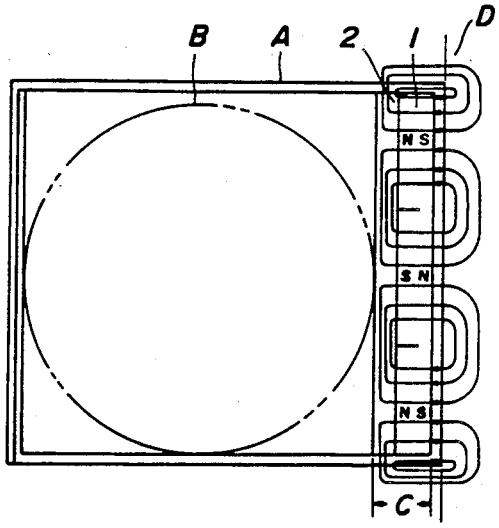
FIG. 2 is a diagram illustrating the magnetic action of the magnetic fixing member in accordance with the present invention.

FIG. 2 is a diagram for explaining the lines of magnetic force at that time. As can be understood clearly from this drawing, the rubber magnet 1 forms a magnetic circuit in cooperation with the side panel D of a refrigerator as the magnetic material and the magnetic plate 2 through a gap corresponding to the thickness of the paper box A. If the rubber magnet 1 is fitted reversely, the magnetic flux connecting the other poles of the rubber magnet does not reach the iron, sheet such as the side panel of the refrigerator even through the external air but forms the magnetic circuit so that the force of magnetic attraction hardly exists and the contemplated object cannot be accomplished.

Figure 3:
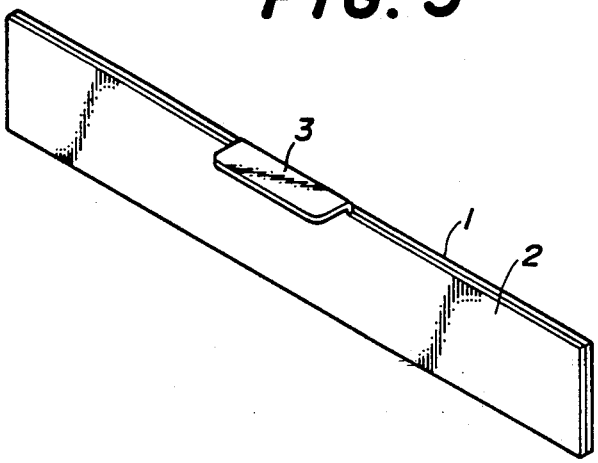
FIGS. 3, 4 and 5 show the magnetic fixing members in accordance with other embodiments of the present invention.
Figure 4:
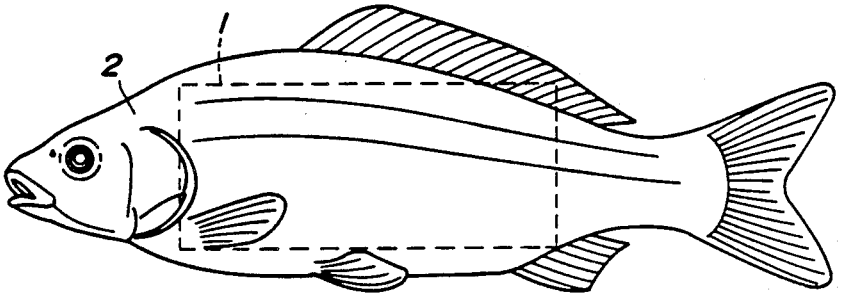

If the magnetic fixing member merely has a rectangular shape as shown in FIG. 1 and, moreover, if the color tone of the rubber magnet 1 is similar to that of the magnetic metal plate 2, there is the possibility that an incorrect fitting may be made in such a manner that the surface of the magnetic metal plate 2 faces the inner side surface of the paper box A and the surface of the rubber magnet 1 faces the wrapper B. However, if the upper end portion of the magnetic metal plate 2 is partly or entirely bent to form a hook 3 as shown in FIG. 3, this mistake can be prevented, because it will be difficult if not impossible to insert the magnetic fixing member in such a manner that the side with the hook 3 faces the inner side surface of the paper box A. Also, if such a hook 3 is formed, the magnetic fixing member can be taken out easily without the necessity of turning upside down the paper box A to withdraw the fixing member. Furthermore, the mistake can be prevented by forming the magnetic metal plate 2 of the magnetic fixing member in a suitable shape such as the one shown in FIG. 4 or by applying to the magnetic metal plate display means, such as a brighter color than the color of the rubber magnet 1, characters, symbols, figures, etc., or display means consisting of a combination of such color, characters, etc. The rubber magnet 1 need not always be fitted to the entire surface of the magnetic metal plate 2 and, if the force of magnetic attraction is satisfactorily great, the rubber magnet may be fitted to only part of the magnetic metal plate 2, as shown in FIG. 4.

Figure 5:
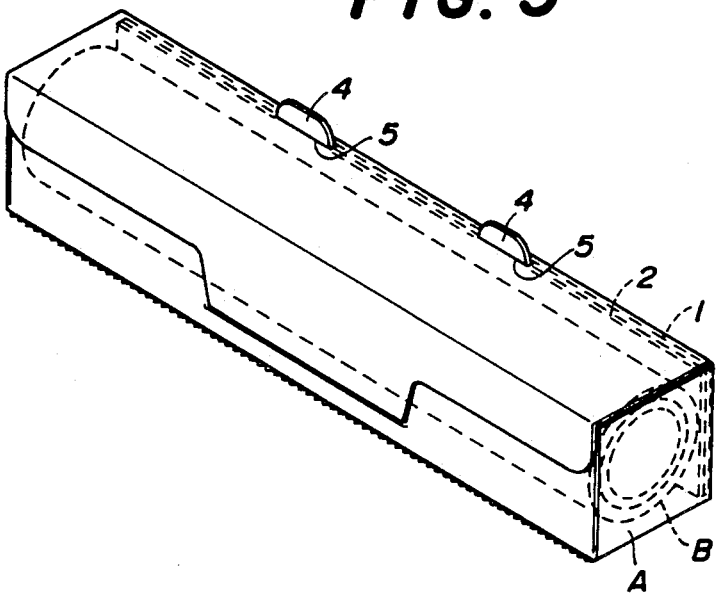

When the paper box A, accommodating therein the magnetic fixing member, is placed on the surface of the refrigerator, the paper box A will drop immediately after one's hand is taken off of it if the magnetic fixing member is not properly situated at the fitting side. Therefore, the embodiment shown in FIG. 5 includes markers 4, 4 formed at the upper edge of the fixing member stored in the paper box in such a manner as to project out from side surface of the paper box A. In the drawing, reference numerals 5 indicate holes for these markers 4, which holes are powdered or bored in the paper box A. In this manner such a mistake can be prevented because the markers 4 indicate the magnetic attraction side.

Deviation of the rubber magnet 1 from the magnetic metal plate 2 can be prevented preferably by bonding them together by use of a duplex adhesive tape. Alternatively, it is possible to form several small projections at suitable positions at the edge of the magnetic metal plate 2 and to bend them, or to form shallow recesses on the magnetic metal plate 2 so as to attract magnetically the rubber magnet 1, though such projections are not shown in the drawing.

Since the magnetic fixing member of the present invention uses a ferrite type anisotropic rubber magnet, the flux density is great, and consequently, the thickness of the magnetic fixing member can be reduced to such an extent that it can be fitted into the limited gap C when the rubber magnet 1 is combined with the magnetic metal plate 2. Though the rubber magnet is in contact with the inner side surface of the paper box A, it does not come into contact with the surface of the refrigerator or the like. Accordingly, the surface of attraction of the refrigerator or the like does not get contaminated by the rubber magnet even if the magnetic fixing member is kept fitted at one position. The magnetic metal plate which comes into contact with the wrapper does not provide any frictional resistance that impedes smooth delivery of the wrapper and the wrapper can be taken out smoothly. Furthermore, since the ferrite type anisotropic rubber magnet and the magnetic metal plate are combined, the magnetic fluxes are gathered and the force of magnetic attraction can be increased so that the paper box A can be held securely. Moreover, at least two poles are magnetized on the thin sheet-like ferrite type anisotropic rubber magnet. Therefore, when the paper box is magnetically attracted to the vertical surface of the refrigerator or the like so that the force of magnetic attraction can firmly prevent the slide and drop of the paper box due to its own weight, a user can take out the wrapper by pinching with hands both of its end portions.

The markers 4 (FIG. 5) projecting out from the paper box A are formed at the upper edge of the portion of the magnetic metal plate which is accommodated in the rectangular shape of the side surface of the paper box A. Accordingly, when the paper box is magnetically attracted to a side panel of the refrigerator, the user can see that the marks 4 indicate which side of the fixing member is the attraction side even through the magnetic fixing member stored in the paper box A cannot be seen from outside, and thus the marks 4 prevent the fall of the paper box A when one's hands are taken off of the paper box A.

If the hook 3 (FIG. 3) for the fingers is formed at the upper edge of the magnetic metal plate, the insertion mistake, i.e., inserting the magnetic fixing member backwards, can be prevented as described already and fitting of the fixing member can be made conveniently. If a suitable shape is provided to the magnetic metal plate, the design effect improves the commercial value of the magnetic fixing member and also prevents the insertion mistake. Also, if the rubber magnet is fitted only to part of the magnetic metal sheet, not only is the insertion mistake prevented, but the cost of production also becomes lower than when the rubber magnet is fitted to the entire surface of the latter.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention will not be limited to the particular embodiments illustrated by the drawings, but is defined by the appended claims.

What is claimed is:

1. In combination, a paper package box having a plurality of sides, and a magnetic fixing member for securing said paper package box to a mounting surface, said magnetic fixing member comprising:

a thin, planar ferrite type anisotropic rubber magnet sheet;

a planar magnetic metal plate secured to a planar surface of said thin, planar, ferrite type anisotropic rubber magnet sheet, said magnetic fixing member being fitted into a gap defined between one side of said paper package box which is to be held against said mounting surface by the force of magnetic attraction of said rubber magnet sheet and contents of said paper package box, and being accommodated in said paper package box with said rubber magnet sheet disposed adjacent said one side of said paper package box and said metal plate disposed adjacent said contents, said rubber magnet sheet having at least two poles magnetized on one plane thereof; and indicating means for distinguishing said magnetic metal plate from said rubber magnet sheet.

2. The combination according to claim 1, wherein said indicating means comprises a hook formed at an upper end of said magnetic metal plate, said hook being bent relative to said magnetic metal plate.

3. The combination according to claim 1, wherein said magnetic metal plate has a first shape and said rubber magnet sheet has a second shape different from said first shape, said rubber magnet sheet being fitted to only a part of said magnetic metal plate, said indicating means being a contrast between said first shape and said second shape.

4. The combination according to claim 1, wherein said indicating means comprises display means for eliminating errors in orienting the magnetic metal plate with respect to said contents provided on a surface of said magnetic metal plate.

5. The combination according to claim 4, wherein said display means comprises a color applied to said magnetic metal plate which contrasts with a color of said rubber magnet.

6. The combination according to claim 4, wherein said display means comprises symbols applied to said magnetic metal plate.

7. In combination, a paper package box having a plurality of sides, and a magnetic fixing member for securing said paper package box to a mounting surface, said magnetic fixing member comprising:

a thin, planar ferrite type anisotropic rubber magnet sheet;

a planar magnetic metal plate secured to a planar surface of said anisotropic rubber magnet sheet, said fixing member being fitted into a gap defined between one side of said paper package box which is to be held against said mounting surface by a force of magnetic attraction of said rubber magnet sheet and contents of said paper package box, said fixing member being accommodated in the paper package box with said rubber magnet sheet disposed adjacent said one side of said paper package box and said metal plate disposed adjacent said contents; and mark portions formed protrusively at an upper end of said portion and projecting through openings in another side of and out of said paper package box, said rubber magnet sheet having at least two poles magnetized on one plane thereof.

* * * * *